US009786973B2

(12) United States Patent
Cherif

(10) Patent No.: US 9,786,973 B2
(45) Date of Patent: Oct. 10, 2017

(54) TUNABLE FILTER USING VARIABLE IMPEDANCE TRANSMISSION LINES

(71) Applicant: TDK Corporation, Tokyo (JP)

(72) Inventor: Bouchaib Cherif, Yorktown Heights, NY (US)

(73) Assignee: TDK Corporation, Tokyo (JP)

( * ) Notice: Subject to any disclaimer, the term of this patent is extended or adjusted under 35 U.S.C. 154(b) by 4 days.

(21) Appl. No.: 14/218,281

(22) Filed: Mar. 18, 2014

(65) Prior Publication Data

US 2015/0270820 A1 Sep. 24, 2015

(51) Int. Cl.
*H01P 1/203* (2006.01)

(52) U.S. Cl.
CPC ..... *H01P 1/2039* (2013.01); *H01P 1/203* (2013.01)

(58) Field of Classification Search
CPC ..... H01P 1/20354; H03H 7/0115
USPC ..... 333/167, 168, 202, 174, 205, 185, 235
See application file for complete search history.

(56) References Cited

U.S. PATENT DOCUMENTS 4,799,034 A 1/1989 Silverman et al.
5,191,304 A 3/1993 Jachowski
6,774,745 B2 8/2004 Apostolos
6,963,259 B2 * 11/2005 Killen ..... H01P 1/2039 333/205
7,145,415 B2 * 12/2006 Sengupta ..... H01P 1/20 333/174
2002/0084871 A1 * 7/2002 Fallahi ..... H03H 7/06 333/168
2009/0134953 A1 * 5/2009 Hunt ..... H01P 1/203 333/168
2010/0109807 A1 5/2010 Iwanami
2010/0164649 A1 * 7/2010 Toncich ..... H01P 1/20 333/174
2012/0057616 A1 * 3/2012 Padilla ..... G01J 3/2803 374/179
2013/0249653 A1 9/2013 Ferrari et al.

OTHER PUBLICATIONS

Chun et al, "BST-Varactor Tunable Dual-Mode Filter Using Variable $Z_c$ Transmission Line," IEEE Microwave and Wireless Components Letters, vol. 18. No. 3. Mar. 2008. pp. 167-169.

* cited by examiner

*Primary Examiner* — Stephen E Jones
(74) *Attorney, Agent, or Firm* — Nixon Peabody LLP

(57) ABSTRACT

Techniques for implementing tunable lumped element filters with transmission line sections. Transmission lines sections are used to implement one or more inductive or capacitance component elements of the filter. The filter is tunable by changing the dielectric constants of the transmission lines. In particular implementations there is an individual transmission line section for each lumped element component of a filter. Different filter circuits may be combined to provide a universal tunable filter assembly.

8 Claims, 10 Drawing Sheets

TUNABLE FILTER USING VARIABLE IMPEDANCE TRANSMISSION LINES

BACKGROUND

Technical Field

This patent application relates generally to radio frequency and microwave frequency filters and more particularly to a filter using variable impedance transmission line sections to synthesize discrete inductive and capacitive elements.

Background Information

Consumer electronic devices such as smart phones, tablets, laptop computers, wireless headphones, video displays and the like are now typically expected to operate using many different radio frequency (RF) and/or microwave frequency communication protocols over a wide range of frequencies. There is increasing pressure for such products to be as small and inexpensive as possible.

These and other electronic products thus require some sort of circuit and/or device to meet the resulting stringent requirements for selecting and controlling frequency. A circuit or component capable of performing frequency selection is called a filter. Filters may be classified based upon how they modify the frequency spectrum of the input signal. Low pass, high pass, band pass, and stop band are some of the more common classes of filters.

Filters may be implemented as a passive design using discrete lumped reactive elements such as inductors and capacitors. The discrete elements can be laid out in a number of different topologies including L-section, T-section, pi-section, ladder-networks, and so forth. Discrete element filters may also use active components such as amplifiers. Filters may also be implemented with specialized structure(s) that take advantage of the electromagnetic effects of various materials and/or physical arrangement of components. Other considerations in filter design include the order, namely the number of poles and zeros, which further determine the characteristics of the frequency response.

Tunable lumped element filters can be implemented using adjustable reactive components such as variable inductors and/or variable capacitors. Tunable filter structures are also known that use mechanical adjustment or electromagnetic effects such as Bragg reflection to effect a change in frequency.

SUMMARY

It is known to implement a tunable filter using variable impedance components such as varactors, and variable impedance transmission lines are known, and still others have constructed variable filters using adjustable dielectric materials to leverage various is electromagnetic effects.

However the present improvements in tunable filters instead use variable impedance transmission line sections to synthesize one or more elements of a lumped-element filter. In one implementation, the capacitors and/or inductors of a lumped element filter design are implemented with corresponding transmission line sections. The resulting circuit is then made tunable by implementing the transmission line sections with a structure which exhibits a variable impedance, such as a substrate for which impedance can be varied. This ability to change the impedance of each transmission line-implemented component thereby allows controlling the overall filter response.

The variable impedance transmission line sections may be formed from a conductor disposed over a certain types of dielectric for which an electromagnetic wave propagation constant may be varied. Barium strontium titanate (BST) is one such material where propagation constant may be varied by changing an applied direct current (DC) voltage. The adjustable dielectric substrate may be a single solid layer, or may be laminated with other material layers as part of a printed circuit board. Other types of variable dielectric substrates may also be used.

In other implementations, a universal filter may be provided by constructing multiple tunable filters in the same assembly. The multiple filters are of different types, for example, bandpass, low pass, high pass, band stop and notch filters. One of these filters can then be selected by controlling the state of switches located at common input and output terminals.

BRIEF DESCRIPTION OF THE DRAWINGS

The description below refers to the accompanying drawings, of which.

DETAILED DESCRIPTION OF AN ILLUSTRATIVE EMBODIMENT

Figure 1A:
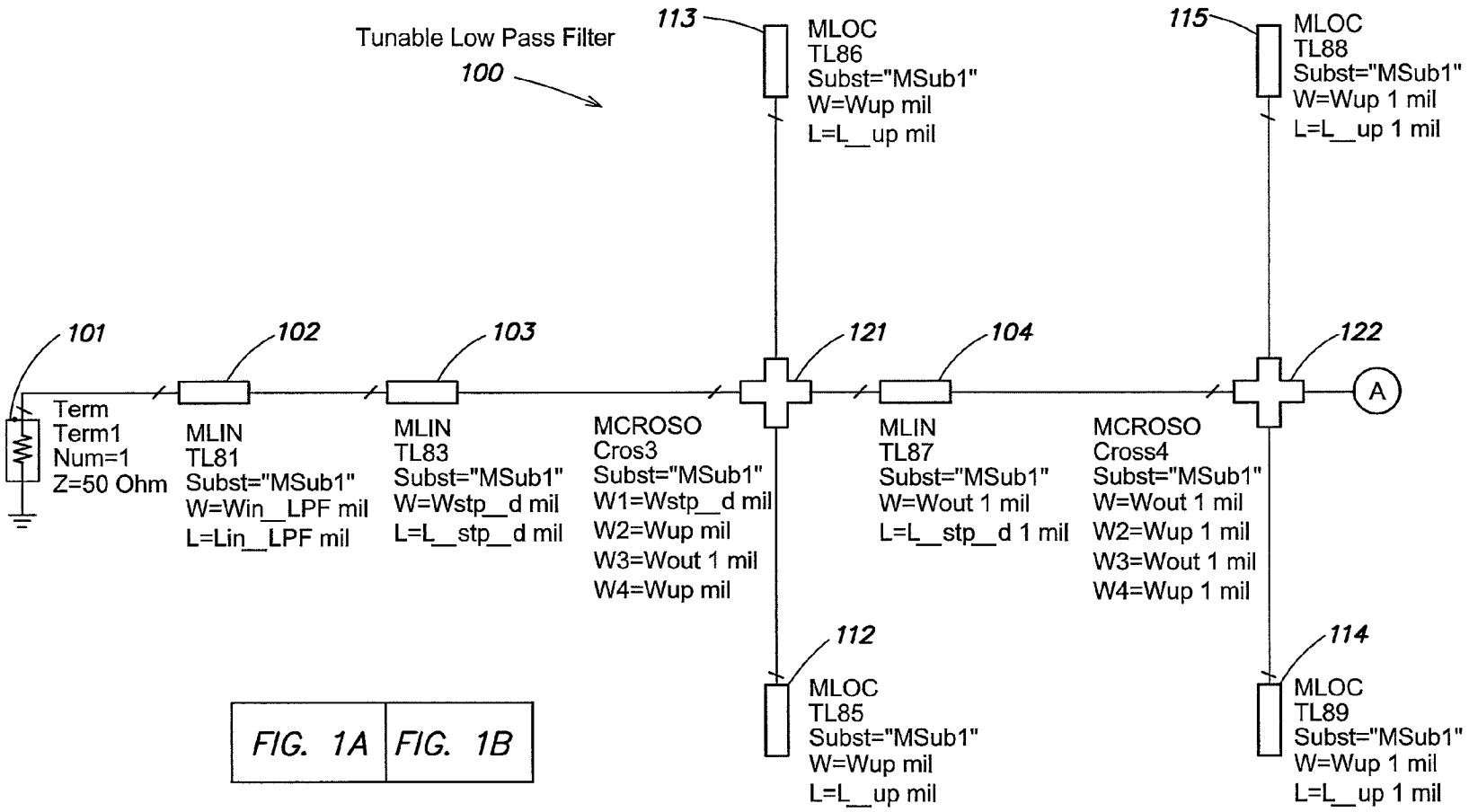
FIGS. 1A and 1B are a schematic diagram of a tunable low pass filter.

As described in more detail below, a tunable microwave frequency filter may be implemented using variable impedance transmission line sections. The variable impedance transmission line sections may be used to synthesize one or more discrete elements in a lumped element filter. For example, a first variable transmission line section may be used to synthesize a variable capacitor, and a second variable transmission line section may be used to synthesize a variable inductor. The overall frequency response of the filter is then tuned by adjusting one or more of the components. In one embodiment, the impedance of the transmission line sections may be adjusted by changing the electromagnetic wave propagation constant of a dielectric material used to implement the transmission line sections. In one such implementation, the transmission line sections may be fabricated as conductive tracks on a printed circuit board, with the printed circuit board having one or more dielectric layers having a dielectric constant that can be adjusted.

The filters may be any desired topology, class or type such as low pass, bandpass, band stop, high pass or the like.

More particularly now, distributed element filters can be obtained by using multiple transmission line sections. When terminated by a load impedance, $Z_L$, a transmission line with characteristic impedance $Z_o$ has an input impedance $Z_{in}$ defined by the following equation:

$$Z_{in} = Z_o \frac{(Z_L + jZ_o \tan\theta)}{(Z_L - jZ_o \tan\theta)}$$

where θ is the electrical length of the transmission line section.

It is observed that:

For transmission line sections implemented on a printed circuit board (PCB), $$\theta = \frac{2\pi * freq * \sqrt{Er}}{C} * L$$

where Er is the dielectric constant of a material layer disposed between a conductive strip and a ground plane, freq is the operating frequency, "C" is the speed of light, and L is the physical length of the transmission line section.

If $Z_L=0$ then $Z_{in}=jZ_0*\tan\theta$; thus a shortened line shares the same input impedance characteristic as an inductor ($Z_{in}=j\omega*ind$)

If $Z_L\infty$ then $$Z_{in} = \frac{z_0}{j\tan\theta};$$

thus an open line behaves like a capacitor.

From the above derivations, it is understood that capacitors and inductors having different impedances can be synthesized with transmission line sections having different dimensions. That is, different values of capacitance $$\left(Z_{in} = \frac{z_0}{j\tan\theta}\right)$$

and inductance ($Z_{in}=jZ_0*\tan\theta$) can be synthesized with respective transmission line sections of different sizes, since $$\theta = \frac{2\pi * freq * \sqrt{Er}}{C} * L,$$

where L is the length of the variable Er section and I results in a corresponding change in $Z_{in}$ of a capacitor and inductor. Whether a given length of transmission line operates as an inductor or capacitor depends primarily on L. If $L<\lambda/4$, then the transmission line section is primarily capacitive, if $L>\lambda/4$, then it becomes primarily inductive. The ultimate impedance presented also depends on other dimensions of the transmission line section, such as width, W.

Most any filter topology can therefore be built using inductors and capacitors implemented with transmission line sections configured in this way.

Figure 1B:
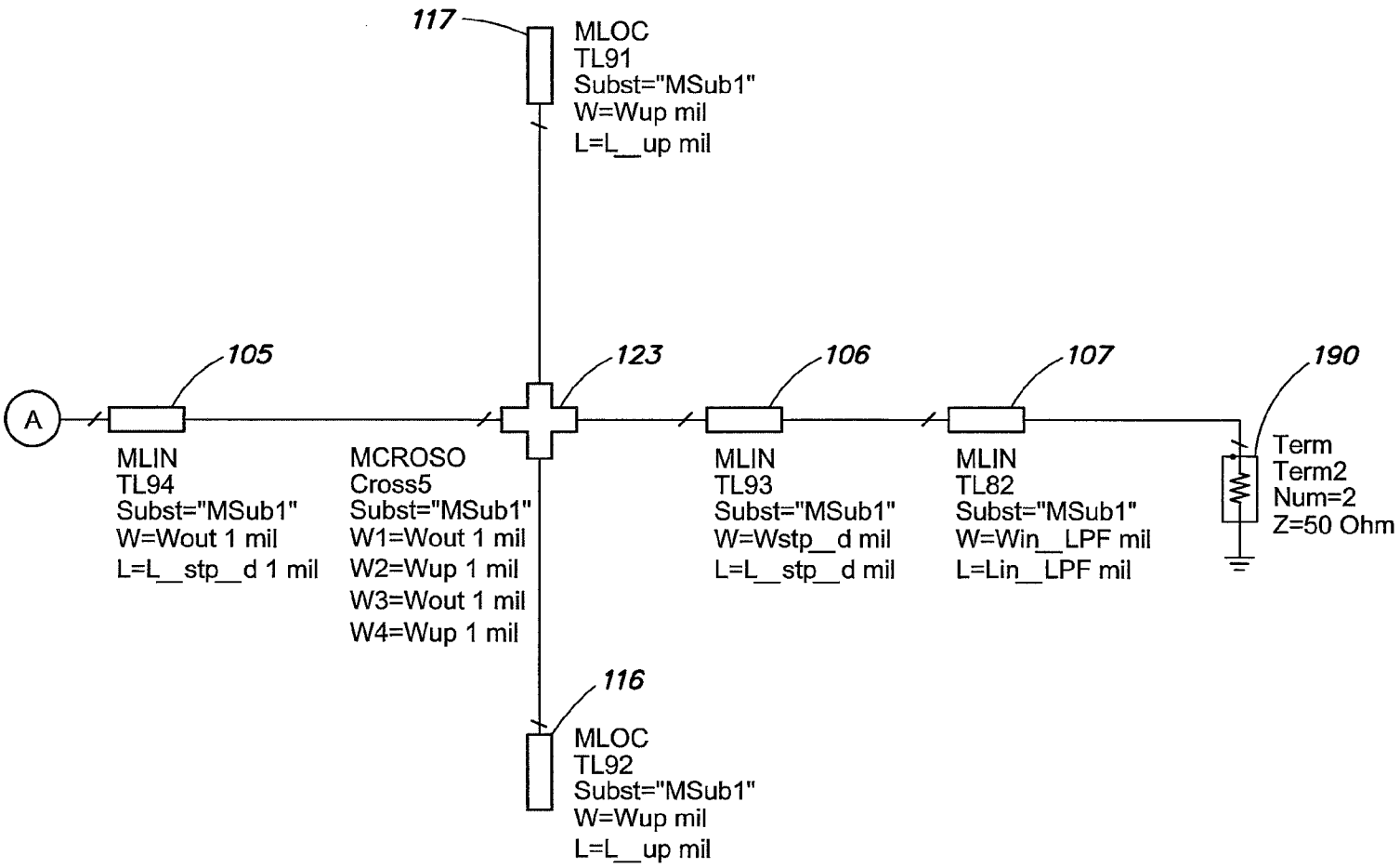

FIGS. 1A and 1B are a schematic of one possible implementation of such a tunable filter exhibiting a low pass response. Input and output termination impedances are provided as 50 ohm resistors 101, 190. The filter consists generally of three L-sections, each section including a series inductance and shunt capacitance. Inductors are provided by variable transmission line sections 102, 103, 104, 105, 106 and 107. Capacitors are provided by variable transmission line sections 112, 113, 114, 115, 116, and 117. In addition, transmission line junction sections 121, 122, 123 are provided between the components.

The characteristics of the individual transmission line sections are written next to each respective element. For example in the case of capacitor 113, the $W=W_{up}$ parameter indicates its width, the $L=L_{up}$ indicates its length, and $substr=M_{sub1}$ indicates the type of substrate.

In the example shown, the transmission line section dimensions are such that $W_{stp_d}$=17 mil, $L_{stp_d}$=170 mil, $W_{in_LPF}$=32 mil, $L_{in_LPF}$=80 mil, $W_{out1}$=10 mil, and $W_{up1}$=17 mil.

An example junction 122 is a four port transmission line section that has widths W1, W2, W3, W4 clockwise from the topmost leg section adjacent capacitor 115.

Although not shown in detail in FIGS. 1A and 1B, each adjustable transmission line section 101, 103, . . . , 117 is implemented with a length of metallic conductor line disposed over a dielectric substrate layer. The dielectric layer has a variable dielectric wave propagation constant which may be controlled, for example, by applying a voltage across it. Suitable dielectric materials may include Barium Strontium Titanate (BST) although other materials are possible.

Figure 2:
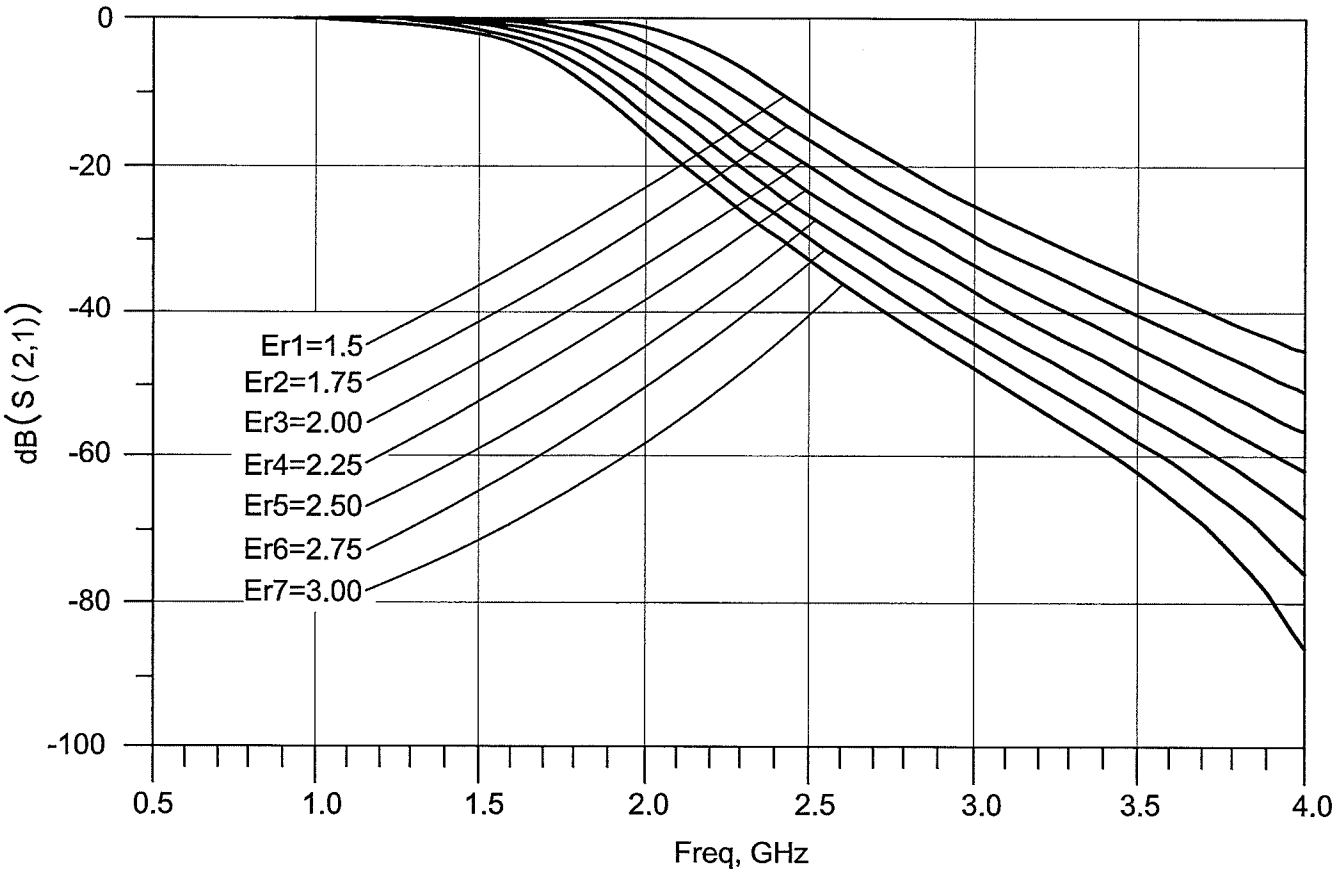
FIG. 2 is an example frequency response for the low pass filter of FIGS. 1A and 1B for various configurations.

FIG. 2 is an expected frequency response diagram for the circuit of FIGS. 1A and 1B. A range of low pass cutoff frequencies, from about 1.75 GHz to about 2.3 GHz is seen to be achievable for different values of $E_r$ ranging from 1.5 to 3.0.

Figure 3A:
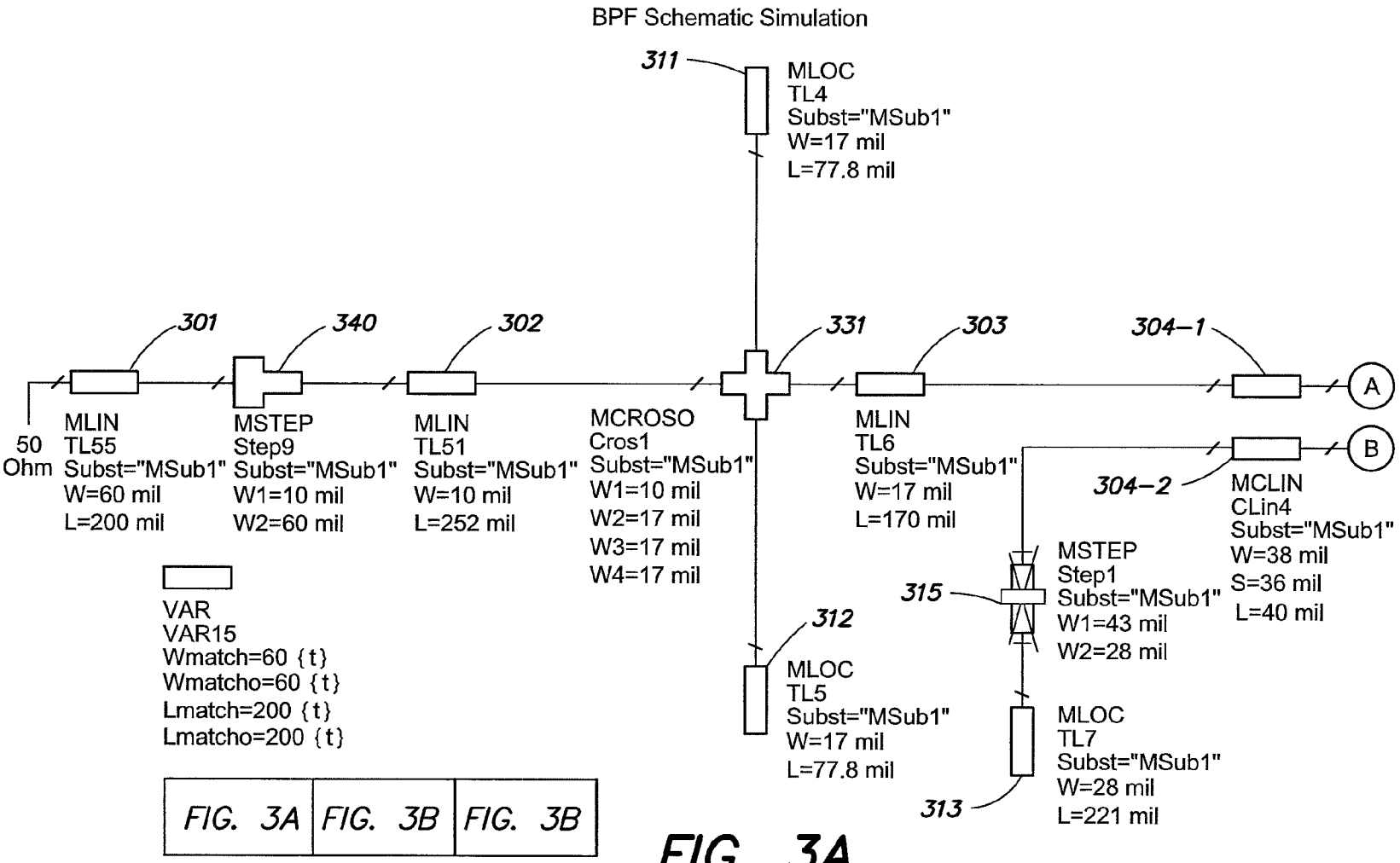
FIGS. 3A, 3B and 3C are a schematic diagram of a tunable bandpass filter.
Figure 3B:
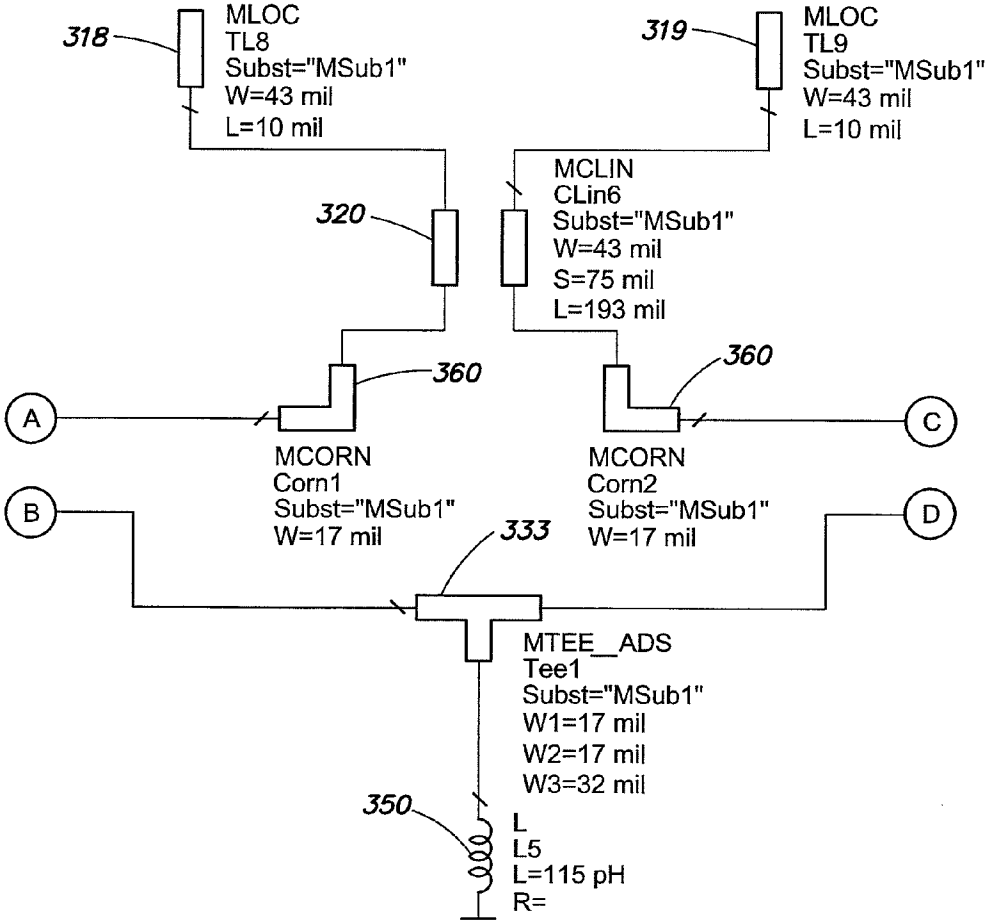
Figure 3C:
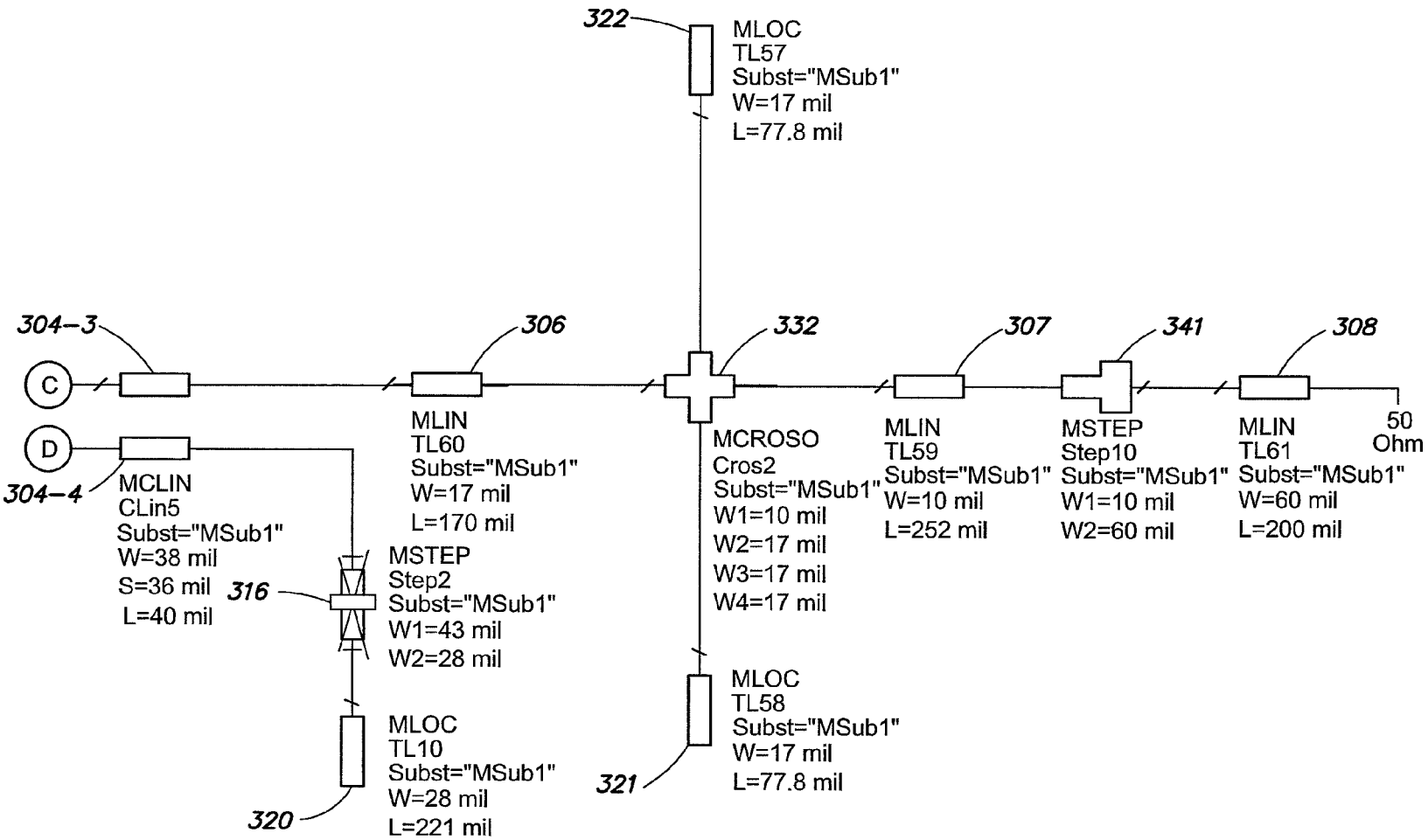

FIGS. 3A, 3B and 3C are a bandpass filter (BPF) implemented using the same techniques as the low pass filter of FIGS. 1A and 1B circuit. This band pass filter consists of a number of transmission line inductor sections 301, 302, 303, 306, 307 and 308. Transmission line capacitor sections include 311, 312, 313, 318, 319, 320, 321, and 322. Junctions 331 and 332 and 333 are also provided as well as couplers 304-1, 304-2, 304-3, 304-4 to interconnect the lumped elements. Also provided in this particular design is a discrete inductor 350 and corners 360.

Components 315 and 316 are stepped impedance lines, used to match input and output impedance. In the example of component 315 and 316, at one end the trace width is 28 mil and at the other end 43 mil. Components 340 and 341 are similar stepped lines, but 60 mil wide at one end, and 10 mil wide at the other end.

This BPF is a particular filter topology (e.g., Chebyshev II) although other filter topologies can be realized.

Figure 4:
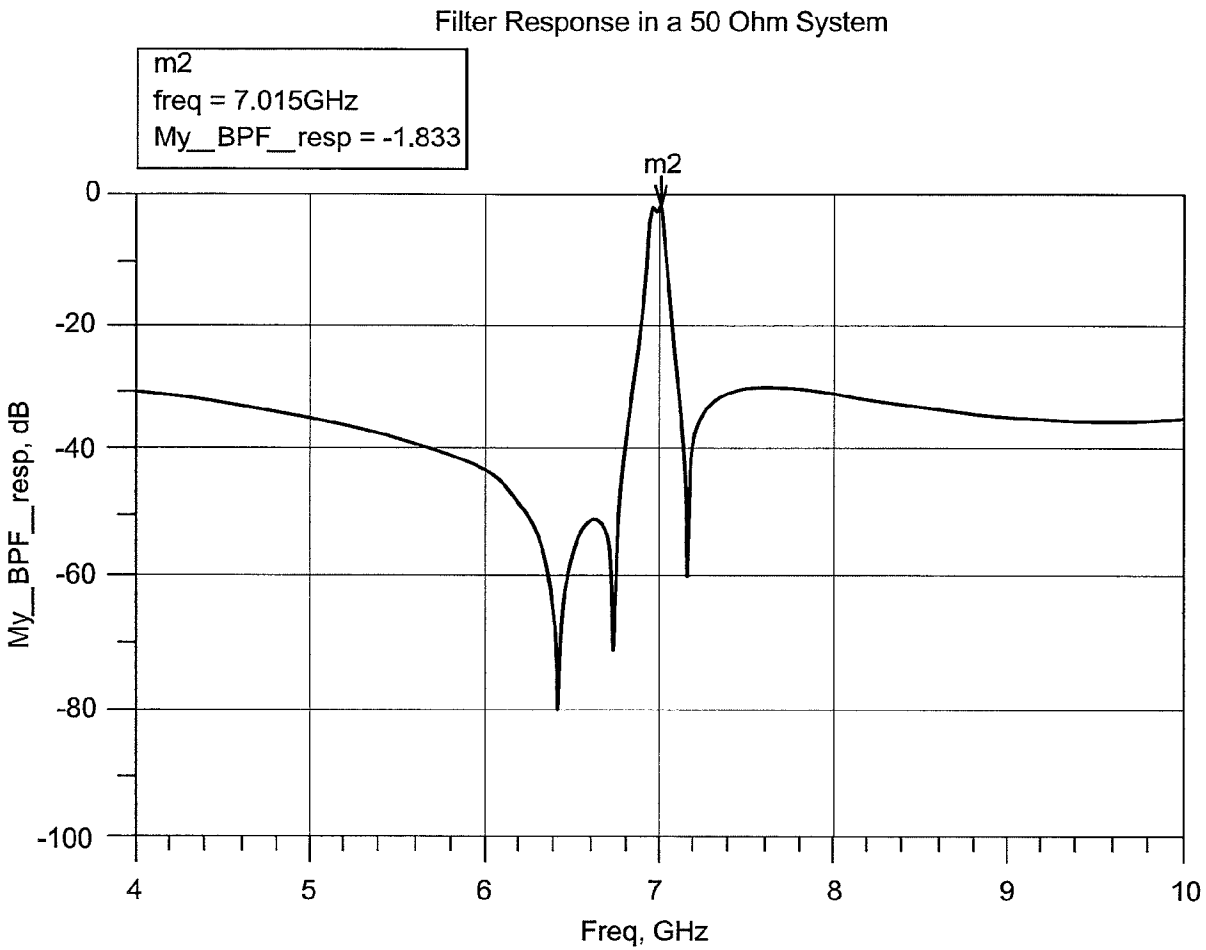
FIGS. 4 and 5 are the frequency response for the bandpass filter of FIG. 3.

FIG. 4 is a filter response for the bandpass design of FIGS. 3A, 3B and 3C, here tuned to a particular frequency of 7.015 GHz, for a substrate Er of 3.38.

Figure 5:
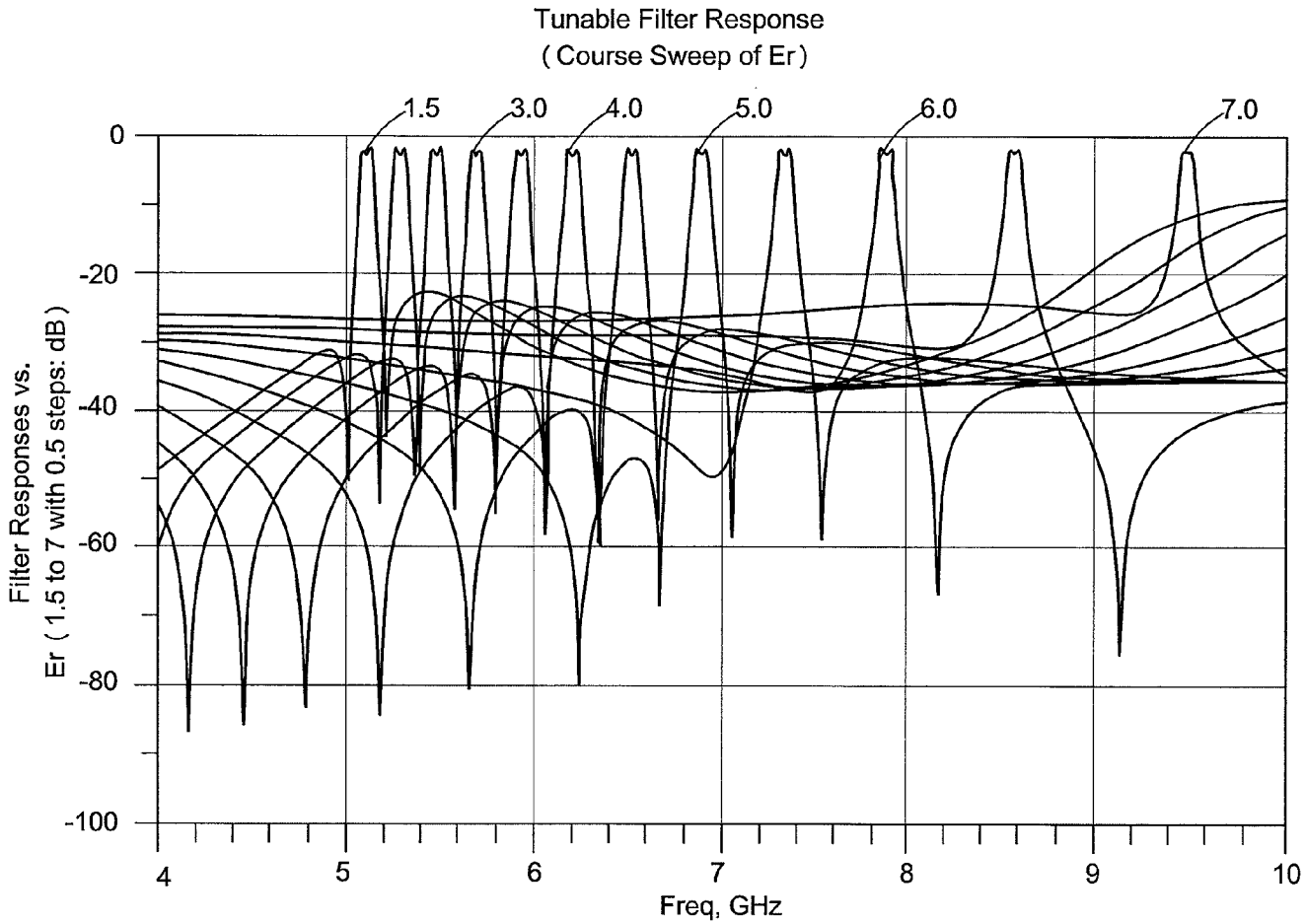

FIG. 5 is a course sweep of the filter design of FIG. 4 obtained by varying the dielectric constant 1.5 to 7, in steps of 0.5. The filter is expected to provide good performance between approximate 5 GHz and a 9 GHz with at least 25 dB of isolation.

Figure 6:
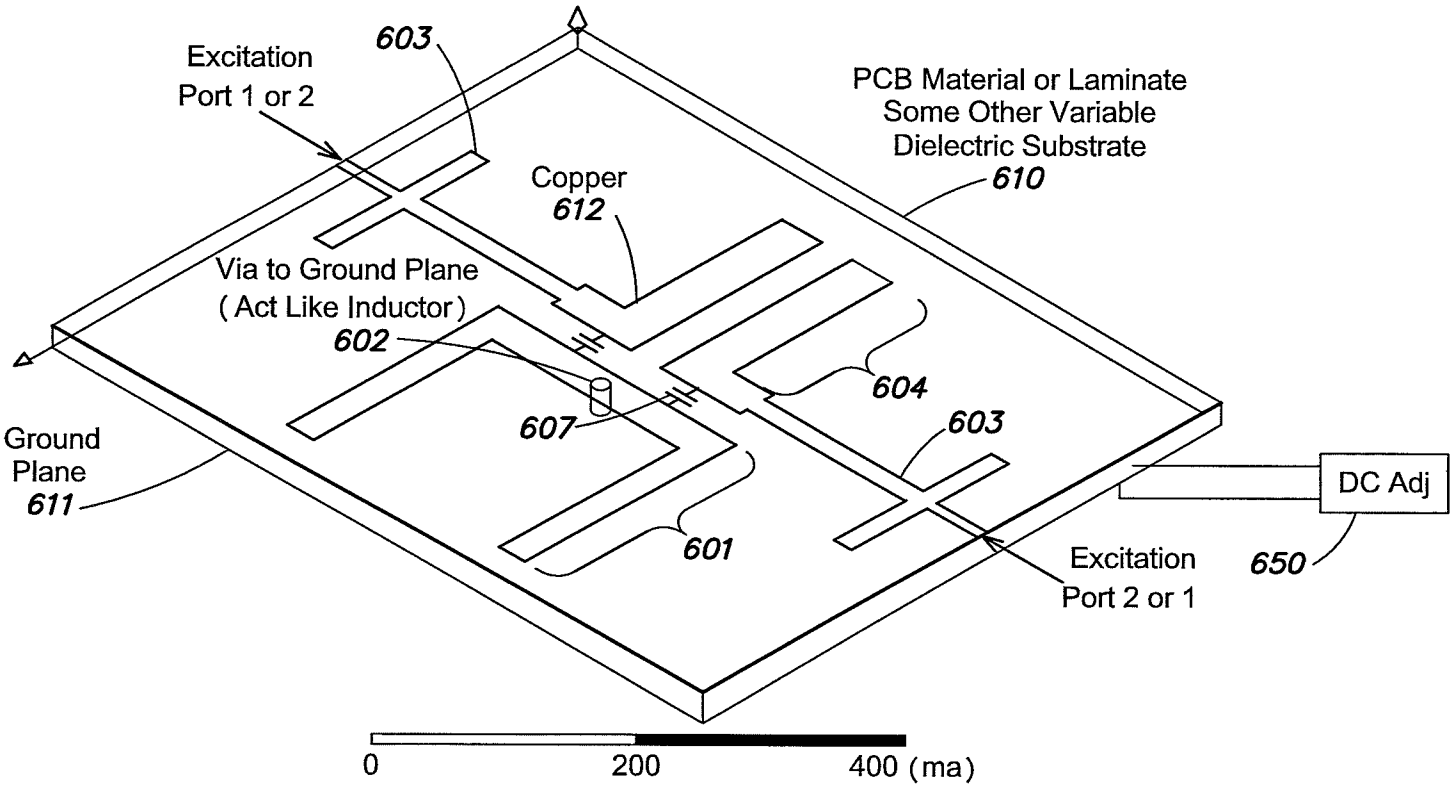
FIG. 6 is an example printed circuit board implementation of certain parts of the filters of FIGS. 1A, 1B and 3A, 3B and 3C.

FIG. 6 illustrates different types of transmission line sections in more detail. Here is seen that a PCB material, laminate, or some other sort of dielectric material substrate 610 is provided with or on a ground plane 611. At least one layer 610 of the substrate is formed of a dielectric having a propagation constant which may be varied such as by impressing a DC voltage across it.

Conductive sections such as formed of copper 612 are placed on the top layer.

A first conductive trace 601 may be one or more straight or meandering line conductors with a via 602 through to the PCB material 610 to the ground plane 611. This straight section with via 602 acts primarily as an inductor. Along with the coupling capacitor(s) 607 between parallel traces, this forms an LCLCL network (see e.g., element 103 of FIG. 1).

Another element 604 is constructed as two conductive traces with a gap between them, and thus implements a capacitive section with capacitor value being a function of the spacing between the lines (e.g., element 112 of FIG. 1A).

Other transmission line sections such as section 603 implement a junction and act as a capacitor element (e.g., element 122 of FIG. 1A).

An adjustable DC voltage source 650 controls a voltage applied to control the propagation constant of the dielectric layer 610.

Figure 7:
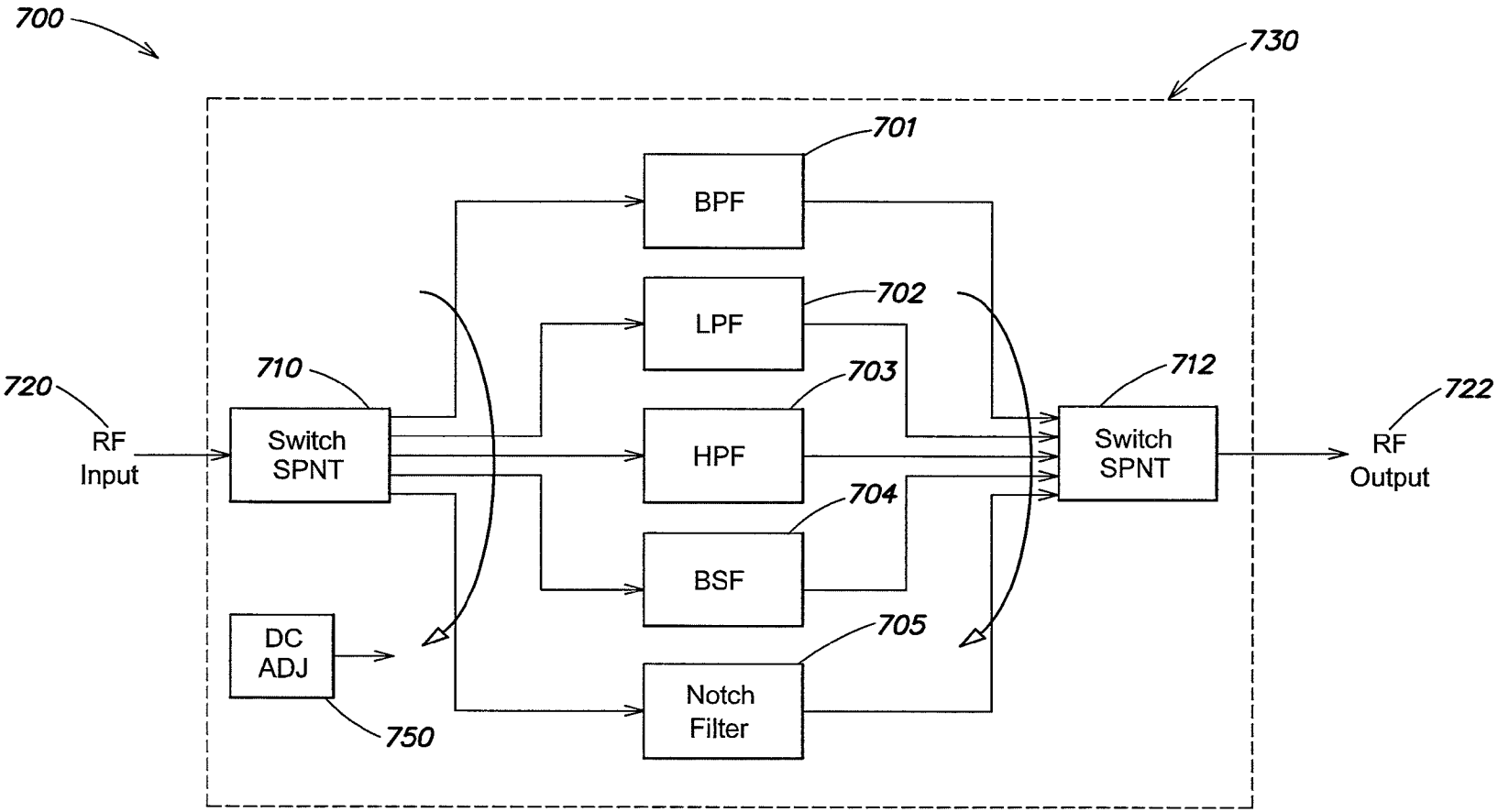
FIG. 7 is a high-level block diagram of a universal filter implemented using a low pass filter, bandpass filter, high pass filter, band stop filter and notch filter, each filter implemented using the techniques described herein.

FIG. 7 illustrates a universal filter 700 that can be constructed by combining is different types of filters in a single assembly. In this example, there may be a tunable band pass filter 701, a tunable low pass filter 702, a tunable high pass filter 703, a tunable band stop filter 704, and a tunable notch filter 705, each implemented with variable transmission line sections as described above. An input switch 710 and output switch 712 may control which filter 701, 702, 703, 704, 705, etc. to which an input signal 720 and output signal 722 are applied. The resulting assembly is a bidirectional such that input and output can be interchangeable.

A dielectric constant controller 750 may apply a DC voltage to the dielectric substrate to set its desired dielectric constant property.

The desired filter function is then chosen by setting the single pole, multiple throw switches 710, 712, to provide input and output connections to the desired filter section. The assembly is conveniently packaged in a common housing 730 so that the device becomes a two terminal RF device i.e., needing only RF input and RF output connections, switch control input settings, and DC voltage to control the transmission line dielectric (not shown).

What is claimed is:

1. A tunable filter apparatus comprising:

at least one capacitive element including a first transmission line section disposed adjacent a first dielectric material section having a dielectric constant; and at least one inductive element including a second transmission line section disposed adjacent a second dielectric material section having a dielectric constant; and an impedance controller connected to effect a change in dielectric constant of the second dielectric material section, the impedance controller configured to thereby change an impedance of the at least one inductive element to adjust the frequency response of the tunable filter.

2. The apparatus of claim 1 wherein the impedance controller effects a change in dielectric constant by controlling a voltage applied to at least the second dielectric material.

3. The apparatus of claim 1 wherein the at least one capacitive element and the at least one inductive element are connected in a filter topology configured as a low pass filter.

4. The apparatus of claim 3 wherein the at least one inductive elements includes at least two inductive elements, the at least two inductive elements are disposed in series between an input terminal and an output terminal of the tunable filter apparatus.

5. The apparatus of claim 4 wherein the at least one capacitive element includes at least two capacitive elements, the at least two capacitive elements are disposed in shunt with respect to the inductive elements.

6. The apparatus of claim 1 wherein the first and the second transmission line sections and the first and the second dielectric material sections are disposed on a printed circuit board having a ground plane.

7. The apparatus of claim 6 wherein the at least one inductive element further comprises a conductive via coupling the second transmission line section to the ground plane.

8. The apparatus of claim 1 additionally comprising:

an input switch having a single input terminal and multiple output terminals;

an output switch having multiple input terminals and a single output terminal;

a set of filter sections, each filter section coupled between a respective one of the multiple output terminals of the input switch and a respective one of the multiple input terminals of the output switch, the filter sections comprising two or more of a low pass filter section formed from a second set of one or more capacitive elements and a second set of one or more inductive elements;

a band pass filter section formed from a third set of one or more capacitive elements and a third set of one or more inductive elements;

a high pass filter section formed from a fourth set of one or more capacitive elements and a fourth set of one or more inductive elements;

a band stop filter section formed from a fifth set of one or more capacitive elements and a fifth set of one or more inductive elements; and a notch pass filter section formed from a sixth set of one or more capacitive elements and a sixth set of one or more inductive elements; and a controller for selecting a state for the input switch and output switch.

* * * * *